US005331938A

United States Patent [19]

Muramatsu et al.

[11] Patent Number: 5,331,938

[45] Date of Patent: Jul. 26, 1994

[54] EVAPORATIVE EMISSION CONTROL SYSTEM FOR INTERNAL COMBUSTION ENGINES

[75] Inventors: Hiroaki Muramatsu; Shinichi Kitajima; Teruo Wakashiro; Hiroshi Kitagawa; Toshikatu Takanohashi, all of Wako; Yoshihiko Kobayashi, Tochigi, all of Japan

[73] Assignee: Honda Giken Kogyo K.K., Tokyo, Japan

[21] Appl. No.: 39,855

[22] Filed: Mar. 30, 1993

[30] Foreign Application Priority Data

Mar. 31, 1992 [JP] Japan ..... 4-105534

[51] Int. Cl.[5] ..... F02M 37/04

[52] U.S. Cl. ..... 123/520; 123/518

[58] Field of Search ..... 123/520, 521, 519, 518, 123/516

[56] References Cited

U.S. PATENT DOCUMENTS

| | | | |
|---|---|---|---|
| 4,527,532 | 7/1985 | Kasai | 123/518 |
| 4,700,683 | 10/1987 | Uranishi | 123/520 |
| 5,060,621 | 10/1991 | Cook | 123/520 |
| 5,103,794 | 4/1992 | Shiraishi | 123/520 |
| 5,172,672 | 12/1992 | Harada | 123/519 |
| 5,190,015 | 3/1933 | Nakata | 123/518 |
| 5,195,495 | 3/1993 | Kitamoto | 123/518 |

FOREIGN PATENT DOCUMENTS

| | | | |
|---|---|---|---|
| 60-21494 | 6/1985 | Japan | 123/520 |

*Primary Examiner*—Carl S. Miller

*Attorney, Agent, or Firm*—Arthur L. Lessler

[57] ABSTRACT

An evaporative emission control system for an internal combustion engine controls purging of evaporative fuel into the intake pipe of the engine. A first control valve is arranged in a communication passage communicating between a charcoal canister and the intake pipe, for supplying the evaporative fuel to the engine at a flow rate dependent on load on the engine. A second control valve is arranged in a bypass passage bypassing the first control valve for supplying the evaporative fuel to the engine at a predetermined flow rate. When a temperature of the engine is below a predetermined value, the first control valve is closed and at the same time the second control valve is made open, to thereby supply the evaporative fuel to the engine at the predetermined i.e. small flow rate. For a predetermined time period after the engine has been warmed up, the first and second control valves are controlled in the same manner. When the engine is idling as well, the same control of the two valves is carried out.

7 Claims, 11 Drawing Sheets

*FIG.2*

| | START AT LOW ENGINE TEMPERATURE (TWCR≦70℃) | | | | | | | | | START AT HIGH ENGINE TEMPERATURE (TWCR>70℃) | | | | | |
|---|---|---|---|---|---|---|---|---|---|---|---|---|---|---|---|
| | TW<50℃ | | | 50℃≦TW<70℃ | | | 70℃≦TW | | | WITHIN PREDETERMINED TIME PERIOD | | | AFTER PREDETERMINED TIME REPIOD | | |
| | IDLE | F/C | Run | IDLE | F/C | Run | IDLE | F/C | Run | IDLE | F/C | Run | IDLE | F/C | Run |
| TWO-STATE VALUE | × | × | × | × | × | ○ | ○ | × | × | ○ | × | ○ | ○ | × | × |
| DUTY CONTROL VALUE | × | × | × | × | × | × | × | × | ◎ | × | × | × | × | × | ◎ |

○ · · · ON × · · · OFF ◎ · · · PURGING IN PROPORTION TO AMOUNT OF INTAKE AIR

| | PBA1 | PBA2 | · · · · | PBA6 |
|---|---|---|---|---|
| QPAIR1 | Duty1.1 | Duty2.1 | · · · · | Duty6.1 |
| QPAIR2 | | | | |
| QPAIR3 | | | | |
| QPAIR4 | | | | |
| QPAIR5 | | | | |
| QPAIR6 | | | | |
| QPAIR7 | | | | |
| QPAIR8 | Duty1.8 | Duty2.8 | · · · · | Duty6.8 |

EVAPORATIVE EMISSION CONTROL SYSTEM FOR INTERNAL COMBUSTION ENGINES

BACKGROUND OF THE INVENTION

1. Field of the Invention

This invention relates to an evaporative emission control system for an internal combustion engine, and more particularly to an evaporative emission control system of this kind which is adapted to control emission of evaporative fuel, including HC, which is adsorbed by a charcoal canister, into the intake system of the engine.

2. Prior Art

Evaporative emission control systems have conventionally been widely used, which control emission of evaporative fuel generated in a fuel tank of an automotive vehicle during stoppage of an internal combustion engine installed therein, into the atmosphere. In such systems, evaporative fuel is adsorbed by a charcoal canister during stoppage of the engine, and is emitted (purged) from the canister during operation of the engine, as disclosed e.g. by Japanese Utility Model Publication (Kokoku) No. 60-21494.

An evaporative fuel emission control system disclosed in this publication is adapted to control an amount of evaporative fuel to be emitted (purged) depending on load on the engine by the use of a restriction hole and a flow rate control valve arranged in parallel with each other in an evaporative fuel-purging passage for purging evaporative fuel adsorbed by a canister into the intake system of an internal combustion engine, and a two-state valve arranged in series with the flow rate control valve. The flow rate control valve starts to open when load on the engine reaches a first predetermined value, and thereafter increases its opening as the load on the engine increases, while the two-state valve closes when the load on the engine is below a second predetermined value lower than the first predetermined value, and also when it is above a third predetermined value higher than the first predetermined value. In this manner, the amount of evaporative fuel purged is restricted under a low load condition of the engine to secure traveling stability of the vehicle under such a low engine load condition, increased under a medium load condition of the engine to stabilize the traveling of the vehicle, and stopped under a high engine load condition when a high engine output is required, to thereby further stabilize the traveling of the vehicle.

However, in the evaporative emission control system constructed as above, negative pressure or intake vacuum is supplied from a portion of the intake pipe upstream of a throttle valve, for controlling the operation of the two-state valve, so that when the engine is idling with the throttle valve closed, pressure within the portion of the intake pipe upstream of the throttle valve becomes equal to atmospheric pressure to close the two-state valve, which makes it impossible to perform purging of evaporative fuel from the canister into the intake system.

On the other hand, if the engine continues to be idling for a long time, evaporative fuel generated in a fuel tank of the engine is supplied to the canister and finally hydrocarbons HC start to be emitted from the canister through an air inlet port thereof. Therefore, particularly in very hot areas of the world, it is required to perform purging of evaporative fuel into the intake system even while the engine is idling.

A possible solution to this problem, i.e. means for performing purging of evaporative fuel even while the engine is idling, would be to provide a duty control valve in the evaporative fuel-purging passage, which is adapted to have its valve opening ratio (duty ratio) controlled according to an amount of intake air, and arrange such that negative pressure is supplied from a portion of the intake pipe downstream of the throttle valve for controlling the operation of the duty control valve. When the engine is idling, however, load on the engine is low, i.e. the amount of intake air is small, and hence it is necessary to control the amount of purged evaporative fuel within a small value range. However, it is difficult for the duty control valve to perform a small flow rate control by duty ratios smaller than 25%. Therefore, there can occur variations in the flow rate of evaporative fuel purged so that the flow rate is unstable, which not only results in degraded exhaust emission characteristics due to fluctuations in the air-fuel ratio of a mixture supplied to the engine but also brings about a problem of offensive noises repeatedly produced by opening and closing motions of the duty control valve.

On the other hand, there is a high possibility that evaporative fuel having a high concentration is supplied to the engine when purging of evaporative fuel is carried out immediately after the start of the engine, because a three way catalyst provided in the exhaust system has not been fully activated due to a low temperature of the engine immediately after the start of the engine. This also causes a problem of unburnt hydrocarbons HC adversely affecting the exhaust emission characteristics.

SUMMARY OF THE INVENTION

It is the object of the invention to provide an evaporative fuel emission control system for an internal combustion engine, which is capable of improving exhaust emission characteristics of the engine, when the engine is in a particular operating condition such as idling and/or immediately after the start of purging of evaporative fuel, and a cold condition, particularly when the engine temperature is low immediately after the start of the engine.

To attain the above object, the present invention provides an evaporative emission control system for an internal combustion engine having a fuel tank, an intake passage, and a throttle valve arranged in the intake passage, the evaporative emission control system including a charcoal canister for adsorbing evaporative fuel generated from the fuel tank, a communication passage communicating between the charcoal canister and a portion of the intake passage downstream of the throttle valve, and a first control valve arranged in the communication passage for controlling supply of the evaporative fuel at a flow rate dependent on an operating parameter of the engine.

The evaporative emission control system according to a first aspect of the invention is characterized by comprising:

a bypass passage bypassing the first control valve and for limiting flow of the evaporative fuel;

a second control valve arranged in the bypass passage for controlling opening and closing of the bypass passage; and control means for closing the first control valve and at the same time opening the second control valve, when the engine is in a warming up state.

Thus, according to the first aspect of the invention, when the temperature of the engine is low, the first control valve is closed and at the same time the second control valve is made open to supply the evaporative fuel at the predetermined flow rate to the engine. Therefore, it is possible to restrict the flow rate of evaporative fuel purged at the low engine temperature, which contains a high concentration of hydrocarbons HC, to thereby improve exhaust emission characteristics of the engine.

Preferably, the evaporative emission control system includes temperature detecting means for detecting a temperature of the engine, and the warming up state of the engine is that the temperature of the engine detected by the temperature detecting means is below a first predetermined value.

More preferably, the control means closes the first control valve and the second control valve to stop supply of the evaporative fuel to the engine, when the temperature of the engine is below a second predetermined value lower than the first predetermined value.

Also preferably, the control means closes the first control valve and the second control valve to stop supply of the evaporative fuel to the engine, when the engine is idling and at the same time the temperature of the engine is below the first predetermined value.

The evaporative emission control system according to a second aspect of the invention is characterized by comprising:

a bypass passage bypassing the first control valve and for limiting flow of the evaporative fuel;

a second control valve arranged in the bypass passage for controlling opening and closing of the bypass passage; and control means for closing the first control valve and at the same time opening the second control valve, over a predetermined time period after the engine starts.

Thus, according to the second aspect of the invention, the first control valve is closed and at the same time the second control valve is made open over the predetermined time period after the engine has started, to thereby allow the evaporative fuel to be supplied to the engine at the predetermined flow rate. Therefore, it is possible to restrict the flow rate of evaporative fuel purged immediately after the start of purging and containing a high concentration of hydrocarbons HC, when the engine has been started in its warmed-up condition, for instance, which leads to improved exhaust emission characteristics of the engine.

The evaporative emission control system according to a third aspect of the invention is characterized by comprising:

a bypass passage bypassing the first control valve and for limiting flow of the evaporative fuel;

a second control valve arranged in the bypass passage for for controlling opening and closing of the bypass passage; and control means for closing the first control valve and at the same time opening the second control valve, when the engine is idling.

Thus, according to the third aspect of the invention, the first control valve is closed and at the same time the second control valve is made open when the engine is idling, to thereby allow the evaporative fuel to be supplied to the engine at the predetermined flow rate. Therefore, it is possible to purge the evaporative fuel via the second control valve at the predetermined or small flow rate while the engine is idling, so that the flow rate of the evaporative fuel becomes stable and the air-fuel ratio of a mixture supplied to the engine is improved to enhance exhaust emission characteristics. Further, when the engine is idling, the first control valve or duty control valve is not used, so that offensive noises due to repeated opening and closing motions of the duty control valve cease to be produced.

Preferably, the control means closes inhibits supply of the evaporative fuel to the engine during idling when the engine has not been warmed up.

The above and other objects, features, and advantages of the invention will be more apparent from the following detailed description taken in conjunction with the accompanying drawings.

BRIEF DESCRIPTION OF THE DRAWINGS

FIG. 2 shows a table showing operative states of a duty control valve and a two-state valve, both appearing in FIG. 1;

DETAILED DESCRIPTION

The invention will now be described in detail with reference to the drawings showing an embodiment thereof.

Figure 1:
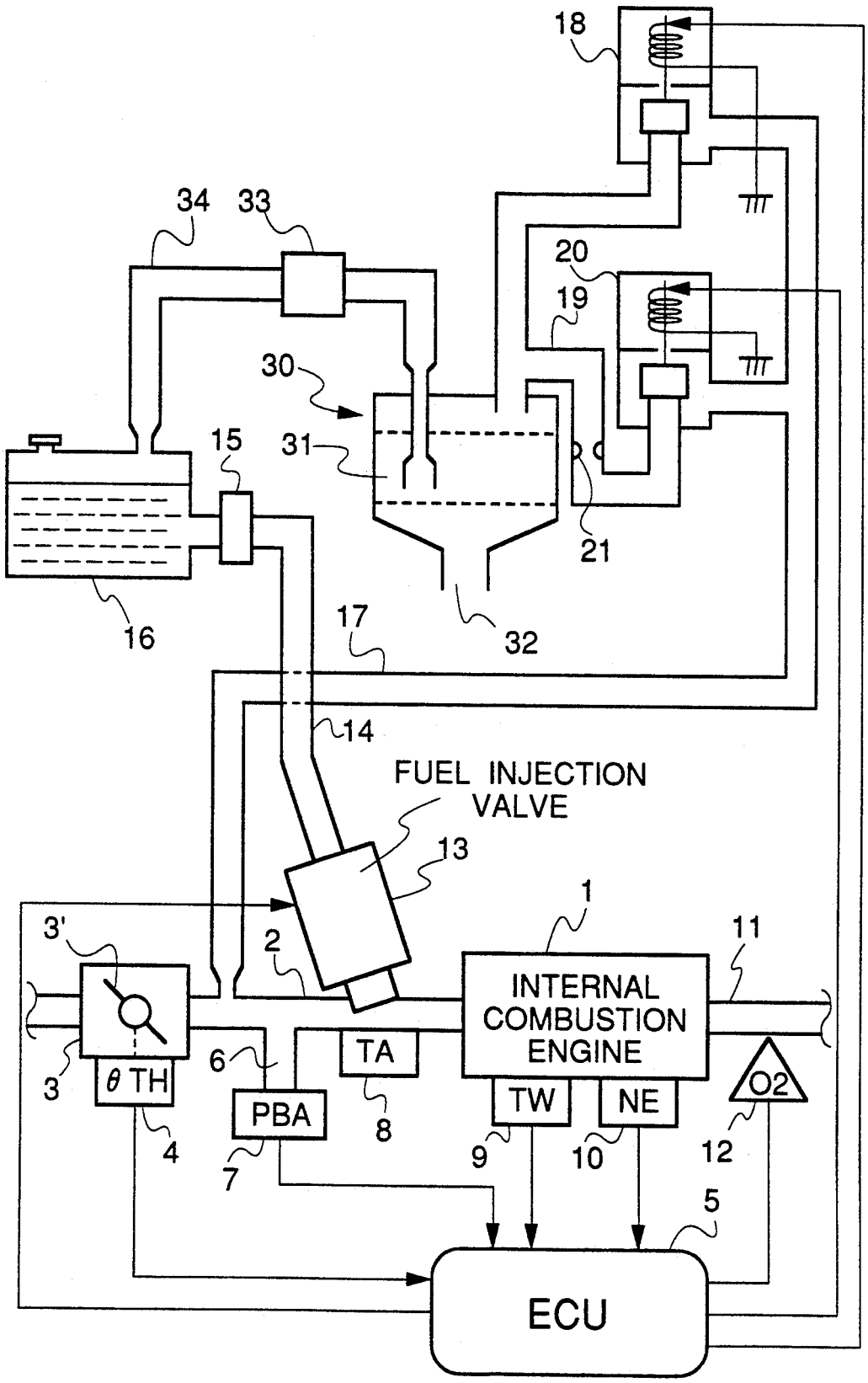
FIG. 1 is a block diagram schematically showing the whole arrangement of an evaporative emission control system for an internal combustion engine, according to an embodiment of the invention.

Referring first to FIG. 1, there is illustrated the whole arrangement of an evaporative emission control system for an internal combustion engine, according to an embodiment of the invention.

In FIG. 1, reference numeral 1 designates an internal combustion engine (hereinafter simply referred to as "the engine") having four cylinders, not shown, for instance. Connected to the cylinder block of the engine 1 is an intake pipe 2 across which is arranged a throttle body 3 accommodating a throttle valve 3' therein. A throttle valve opening (θTH) sensor 4 is connected to the throttle valve 3' for generating an electric signal indicative of the sensed throttle valve opening and supplying same to an electronic control unit (hereinafter referred to as "the ECU") 5.

Further, a conduit 6 branches off the intake pipe 2 at a location downstream of the throttle valve 3', and an intake pipe absolute pressure (PBA) sensor 7 is mounted at a closed end of the conduit 6, for supplying an electric signal indicative of the sensed absolute pressure PBA to the ECU 5.

An intake air temperature (TA) sensor 8 is inserted into the intake pipe 2 at a location downstream of the conduit 6, for supplying an electric signal indicative of the sensed intake air temperature TA to the ECU 5.

An engine coolant temperature (TW) sensor 9 formed of a thermistor or the like is inserted into a coolant passage filled with a coolant and formed in the cylinder block, for supplying an electric signal indicative of the sensed engine coolant temperature TW to the ECU 5.

An engine rotational speed (NE) sensor 10 is arranged in facing relation to a camshaft or a crankshaft of the engine 1, neither of which is shown. The engine rotational speed sensor 10 generates a pulse as a TDC signal pulse at each of predetermined crank angles whenever the crankshaft rotates through 180 degrees, the pulse being supplied to the ECU 5.

An oxygen concentration ($O_2$) sensor (hereinafter referred to as "the $O_2$ sensor") 12 is inserted into an exhaust pipe 11 extending from the engine 1, for supplying an electric signal indicative of the sensed oxygen concentration in exhaust gases to the ECU 5.

Fuel injection valves 13, only one of which is shown, are inserted into the interior of the intake pipe 2 at locations intermediate between the cylinder block of the engine 1 and the throttle valve 3' and slightly upstream of respective intake valves, not shown. The fuel injection valves 13 are connected to a fuel tank 16 via a fuel supply pipe 15 having a fuel pump 15 interposed therein, and electrically connected to the ECU 5 to have their valve opening periods controlled by signals therefrom.

A purging passage 17 branches off the intake pipe at a location intermediate between the throttle valve 3' and the conduit 6, and is connected to a charcoal canister 30 via a duty control valve 18.

Further, reference numeral 19 designates a bypass passage bypassing the duty control valve 18, which is formed therein with an jet orifice (restriction) 21 and has a two-state valve 20 arranged thereacross in series with the jet orifice 21.

The duty control valve 18 has a solenoid thereof electrically connected to the ECU 5, which performs duty control of the duty control valve 18 to control a flow rate of evaporative fuel purged through the purging passage 17 according to an amount of intake air drawn into the intake pipe 2.

The two-state valve 20 has a solenoid thereof electrically connected to the ECU 5, which performs ON/-OFF control of the two-state valve 20 to control a flow rate of evaporative fuel purged through the purging passage 17 in response to a control signal from the ECU 5. When opened, the two-state valve 20 allows evaporative fuel to flow therethrough at a predetermined flow rate.

The duty control valve 18 and the two-state valve 20 are controlled as shown in FIG. 2, depending on operating conditions of the engine. In FIG. 2, a double circle indicates an open state of the duty control valve 18, a single circle an open state (i.e. ON) of the two-state valve 20, and a cross a closed state of the duty control valve 18 and a closed state (OFF) of the two-state valve 20. These operative states of the valves 18 and 20 shown in FIG. 2 will be described in detail later.

Further, the charcoal canister 30 contains an adsorbent 31, such as activated charcoal, and is formed with an outside air inlet port 32. The charcoal canister 30 is connected to a fuel tank 16 via a communicating passage 34 across which a two-way valve 33 is arranged.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), memory means storing programs executed by the CPU and for storing results of calculations therefrom, etc., and an output circuit which outputs driving signals to the fuel injection valves 13, the duty control valve 18, and the two-state control valve 20.

The CPU determines various engine operating conditions, such as a feedback control region in which the air-fuel ratio control should be carried out in a feedback manner according to concentration of oxygen in exhaust gases, and open-loop control regions, based on engine operating parameters detected by the sensors described above, and calculates a fuel injection period Tout over which each of the fuel injection valves 6 should be opened in synchronism with generation of a TDC signal pulse, by the use of the following equation (1):

$$Tout = Ti \times KO2 \times K1 + K2 \quad (1)$$

where Ti represents a basic value of the fuel injection period Tout, which is read from a Ti map according to the engine rotational speed NE and the intake pipe absolute pressure PBA.

KO2 represents an air-fuel ratio correction coefficient which is set according to the oxygen concentration in exhaust gases detected by the $O_2$ sensor 12 during a feedback control mode, and to predetermined values when the engine is in the abovementioned open-loop control regions, respectively.

K1 and K2 represent other correction coefficients and correction variables, respectively, determined according to engine operating parameters and the battery voltage VB, and are set to such values as optimize engine operating characteristics, such as fuel consumption and engine accelerability.

In the evaporative emission control system constructed as above, when the pressure of evaporative fuel generated in the fuel tank reaches a predetermined level, a positive pressure valve, not shown, of the two-way valve 33 is forced to open to allow the evaporative fuel to flow into the canister 30, where it is adsorbed by the adsorbent 31 for storage.

The duty control valve 18 and the two-state valve 20 are subjected to duty control and ON/OFF control, respectively, according to a program described hereinbelow with reference to FIG. 3 and FIG. 4. When at least one of the duty control valve 18 and the two-state valve 20 is open, evaporative fuel temporarily stored in the canister 30 is drawn into the intake pipe 2 via the duty control valve 18 and/or the bypass passage 19, together with outside air drawn through the outside air inlet port 32 into the canister 30.

Figure 3:
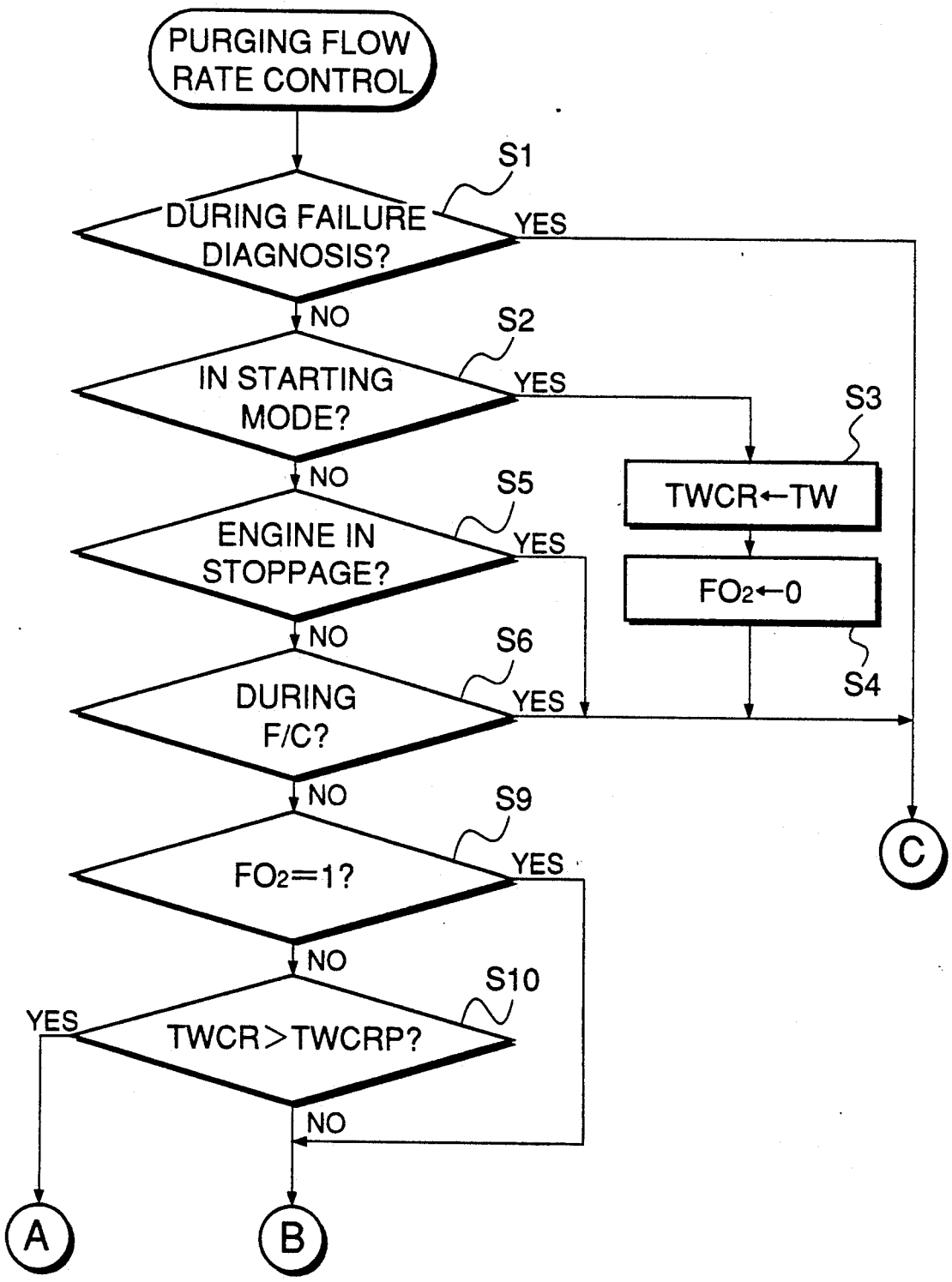
FIG. 3 is part of a flowchart of a program for controlling a flow rate of evaporative fuel purged.
Figure 4:
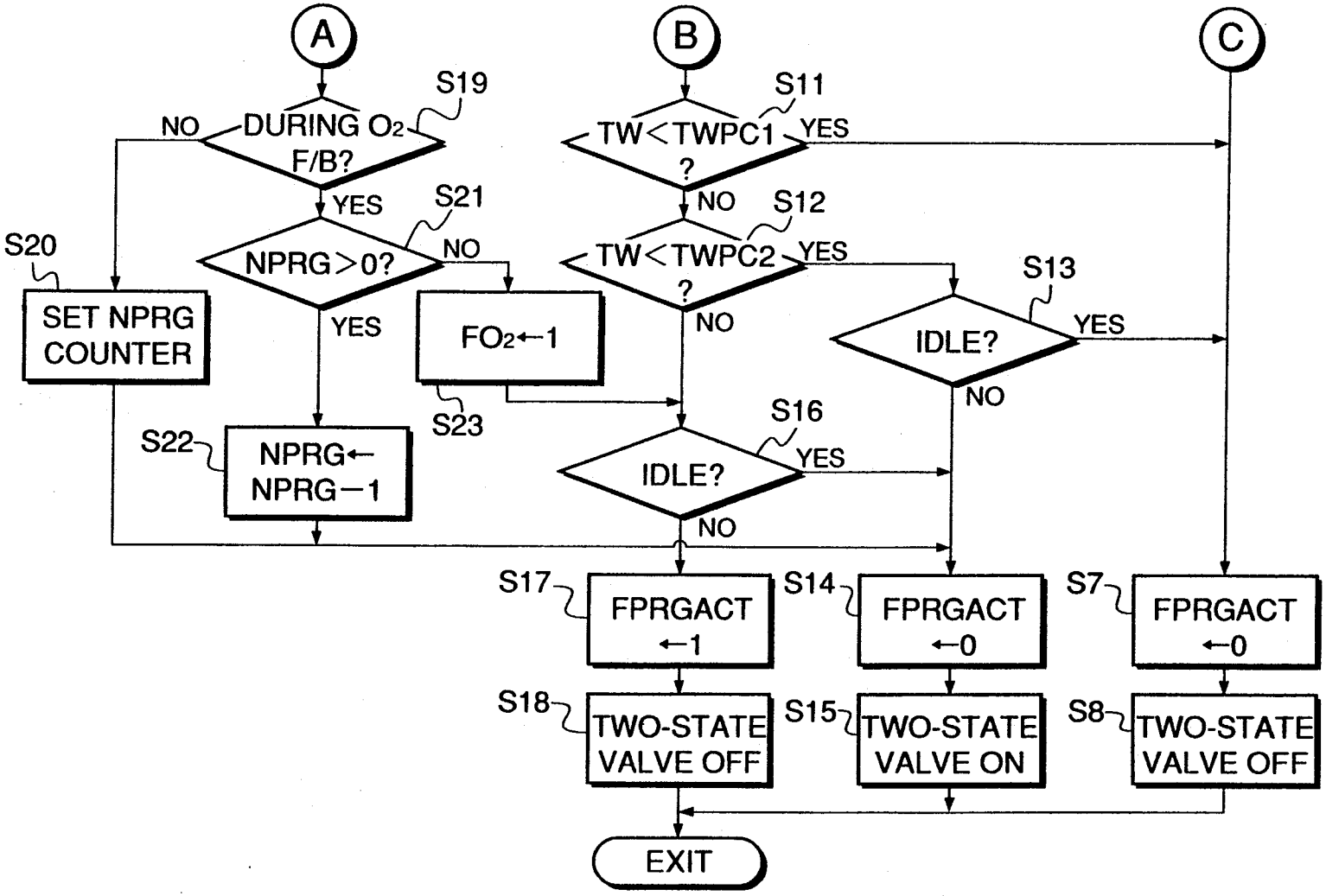
FIG. 4 is a flow chart of the rest of the program of FIG. 3.

The program of FIG. 3 and FIG. 4 is carried out as background processing, i.e. as the lowest priority processing to be carried out when no higher priority processing should be executed.

First, a a step S1, it is determined whether or not failure diagnosis is being carried out on the evaporative emission control system. The failure diagnosis of the evaporative emission control system is for determining whether this system is faulty or not, by forcibly establishing a predetermined negatively pressurized state of the system and measuring changes in pressure level occurring with the lapse of time within the fuel tank after the predetermined negatively pressurized state of the system is established. If the answer to this question is negative (NO), i.e. if the failure diagnosis of the evaporative emission control system is not being carried out, the program proceeds to a step S2, where it is determined whether or not the engine 1 is in a starting mode (or cranking). If the answer to this question is affirmative (YES), a coolant temperature value TWCR at the start of the engine is stored at a step S3, and a flag F02 is set to "0" at a step S4, whereas if the answer to the question of the step S2 is negative (NO), the program proceeds to a step S5.

At the step S5, it is determined whether or not the engine is in stoppage. If the answer to this question is negative (NO), it is determined at a step S6 whether or not the engine 1 is under fuel cut (F/C). When any of the results of determinations at the steps S1, S2, S5 and S6 is affirmative (YES), the following steps S7 and S8 are carried out. Namely, a flag FPRGACT is set to "0" at the step S7 to allow the duty control valve 18 to remain closed without performing the duty control of same, and the two-state valve 20 is allowed to remain closed (or OFF) at the step S8.

Thus, while the failure diagnosis of the evaporative emission control system is carried out, when the engine is in the starting mode, in stoppage, or under fuel cut, the flag FPRGACT is reset to "0" to inhibit evaporative fuel from being purged into the intake system ("purge cut"). On the other hand, if all the results of the determinations at the steps S1, S2, S5 and S6 are negative (NO), it is determined at a step S9 whether or not the flag FO2 is equal to "1", and then the program proceeds to a step S10 or a step S11 depending upon the answer to the step S9, to carry out purging of evaporative fuel.

If the answer to the question of the step S9 is negative (NO), i.e. if the flag FO2 is not equal to "1", the program proceeds to the step S10, where it is determined whether or not the coolant temperature TWCRP detected at the start of the engine is higher than a predetermined value TWCRP (e.g. 70° C.). If the answer to this question is negative (NO), i.e. if the engine was started in a cold condition, i.e. with the coolant temperature TWCR being equal to or lower than the predetermined value TWCRP, the program proceeds to the step S11. On the other hand, if the answer to the question of the step S9 is affirmative (YES), i.e. if the flag FO2 is equal to "1" as well, the program skips over the step S10 to the step S11. Thus, the step S10 is skipped over and the program directly proceeds to the step S11 when the flag FO2 is equal to "1", since the processing at the steps S19 to S23 has only to be carried out once after the start of the engine. At the step S11, it is determined whether or not a present value of the coolant temperature TW is lower than a predetermined value TWPC1 (e.g. 50° C.). If the answer to this question is affirmative (YES), i.e. if the coolant temperature TW is so low below the predetermined value TWPC1, the program proceeds to the steps S7 and S8, to perform "purge cut" (see FIG. 2).

On the other hand, if the answer to the question of the step S11 is negative (NO), i.e. if the present value of the coolant temperature TW is equal to or higher than the predetermined value TWPC1 (e.g. 50° C.), it is judged that the engine is being warmed up, the program proceeds to a step S12, where it is further determined whether or not the present value of the coolant temperature TW is lower than a predetermined value TWPC2 (e.g. 70° C.). If the answer to this question is affirmative (YES), i.e. if $TWPC1 \leqq TW < TWPC2$, the program proceeds to a step S13, where it is determined whether or not the engine is idling. If the answer to this question is negative (NO), i.e. if the vehicle is traveling, the flag FPPRGACT is set to "0" at the step S14 to hold the duty control valve 18 in its closed state without performing duty control, as described hereinabove, and at a step S15, the two-state valve 20 is turned on (i.e. opened). As a result, a flow of evaporative fuel through the bypass passage 19, which has its maximum flow rate restricted to a small value by the jet orifice 21, is purged into the intake system. This prevents hydrocarbons HC from adversely affecting exhaust emission characteristics, which are contained in a high concentration in evaporative fuel supplied from the canister 30 during warming-up of the engine after the start of same.

Further, if the answer to the question of the step S13 is affirmative (YES), i.e. if the engine is idling under the condition of TWPC1 (50° C.) $\leqq TW < TWPC2$ (70° C.), the program proceeds to the steps S7 and S8 to perform "purge cut" (see FIG. 2).

On the other hand, if the answer to the question of the step S12 is negative (NO), i.e. if the engine has been warmed up to such a degree that the coolant temperature assumes a value equal to or higher than the predetermined value TWPC2, the program proceeds to a step S16, where it is determined whether or not the engine is idling. If the answer to this question is negative (NO), i.e. if the vehicle is traveling, the flag FPRGACT is set to "1" at a step S17 to thereby perform the duty control of the duty control valve 18 according to a routine, described hereinafter. Then, at a step S18, the two-state valve 20 is turned off or caused to remain off (closed) (see FIG. 2).

Further, if the answer to the question of the step S16 is affirmative (YES), i.e. if the present value of the coolant temperature TW is equal or higher than the predetermined value TWPC2 and at the same time the engine is idling, the above-mentioned steps S14 and S15 are carried out to thereby turn on (open) the two-state valve 20 alone (see FIG. 2).

Thus, when the engine is started under such a cold condition that the coolant temperature TW is lower than e.g. 70° C., the duty control valve 18 and the two-state valve 20 are controlled as shown in columns under START AT LOW ENGINE TEMPERATURE in FIG. 2.

Figure 5:
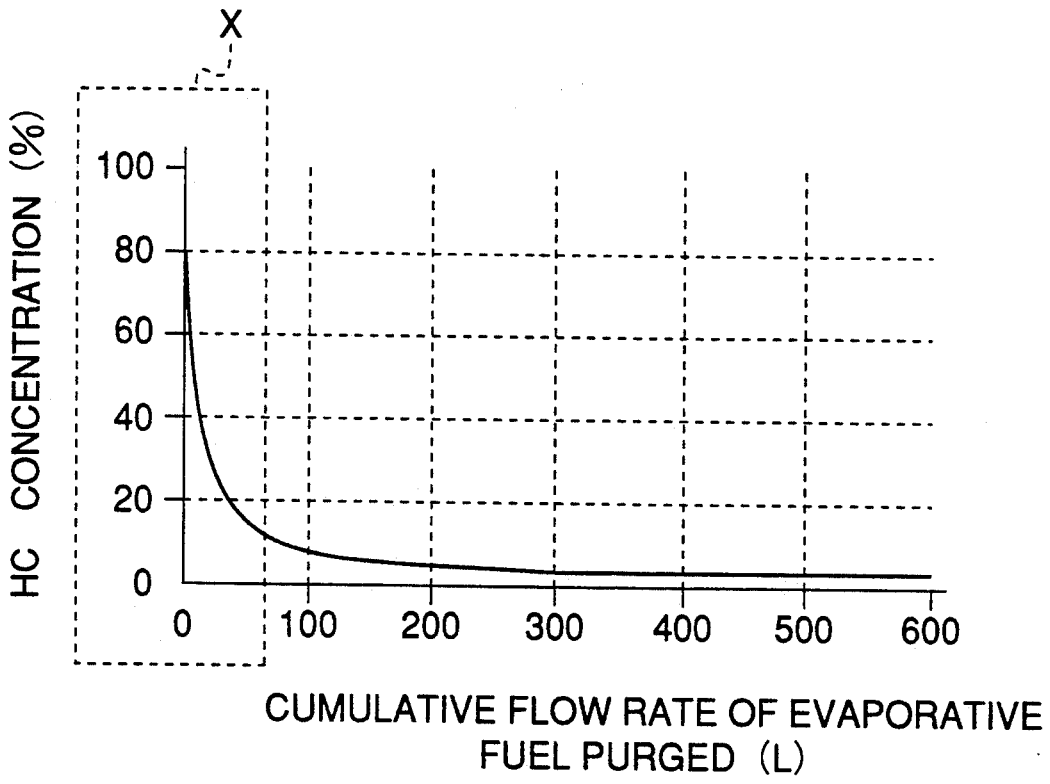
FIG. 5 is a graph showing the relationship between concentration of HC and an accumulated volume of evaporative fuel purged.

On the other hand, if the answer to the question of the step S10 is affirmative (YES), i.e. if the engine was started under such a warm condition that the coolant temperature TWCR detected at the start of the engine is higher than the predetermined value TWCRP (e.g. 70° C.), the program proceeds to a step S19, where it is determined whether or not the air-fuel ratio feedback control is being carried out. If the answer to this question is negative (NO), i.e. if the air-fuel ratio feedback control is not being carried out, the program proceeds to a step S20, where a predetermined value NPRG (corresponding to a predetermined time period after the start of the engine) is set to a counter, not shown, and then the aforementioned steps S14 and S15 are carried out to purge evaporative fuel at a low flow rate. If the answer to the question of the step S19 is affirmative (YES), i.e. if the air-fuel ratio feedback control is being carried out, it is determined at a step S21 whether or not the count value of the above-mentioned counter is larger than "0". If the answer to this question is affirmative (YES), i.e. if the predetermined time period has not elapsed after the start of the engine, the count value of the counter is decreased by a decremental value of 1, and the steps S14 and S15 are carried out to purge evaporative fuel at a low flow rate determined by the jet orifice 21 (see FIG. 2). This is for preventing of hydrocarbons HC from adversely affecting exhaust emission characteristics, since evaporative fuel containing a high concentration of hydrocarbons HC as indicated by X in FIG. 5 is supplied from the canister.

If the answer to the question of the step S21 is negative (NO), i.e. if the count value of the counter is equal to or smaller than "0", it is judged that the engine has been warmed up on or after the lapse of the predetermined time period after the start of the engine, so that the flag FO2 is set to "1" at a step S23, and subsequently the aforementioned step 16 is carried out. Similarly to the above, if the vehicle is traveling, the flag FPRGACT is set to "1" at the step S17 to perform the duty control of the duty control valve 18, and at the step S18, the two-state valve 20 is turned off or caused to remain off (closed) (see FIG. 2). Consequently, the flow rate of evaporative fuel purged is controlled in proportion to the amount of intake air according to the routine described hereinafter. Further, if the engine is idling, the steps S14 and S15 are carried out to purge evaporative fuel at a low flow rate by means of the jet orifice 21 (see FIG. 2).

Thus, when the engine is started in such a warm condition that the coolant temperature TW is higher than 70° C., for example, the duty control valve 18 and the two-state valve 20 are controlled as shown in columns under START AT HIGH ENGINE TEMPERATURE in FIG. 2.

Figure 6:
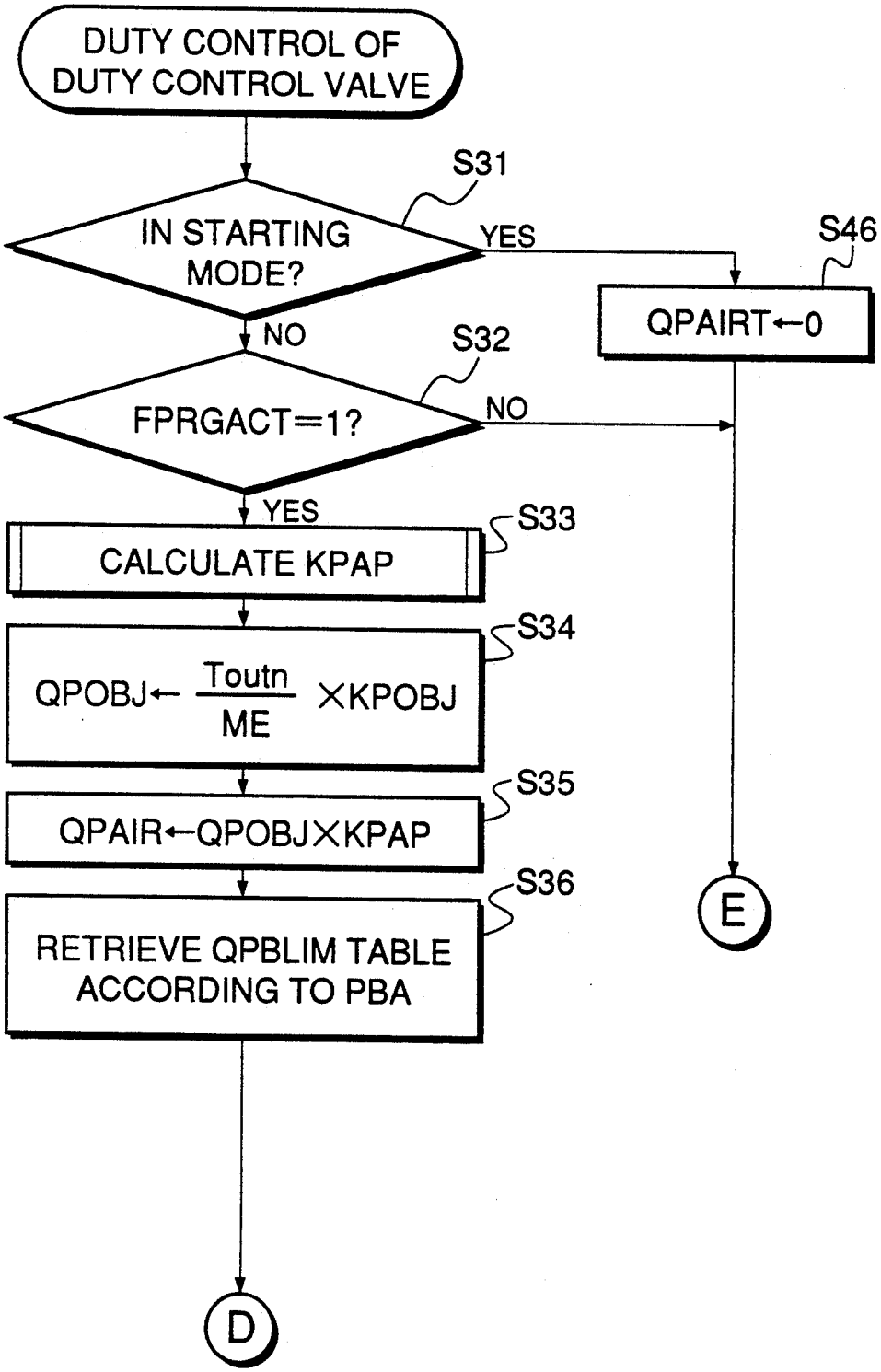
FIG. 6 is part of a flowchart of a program for executing duty control by the duty control valve.
Figure 7:
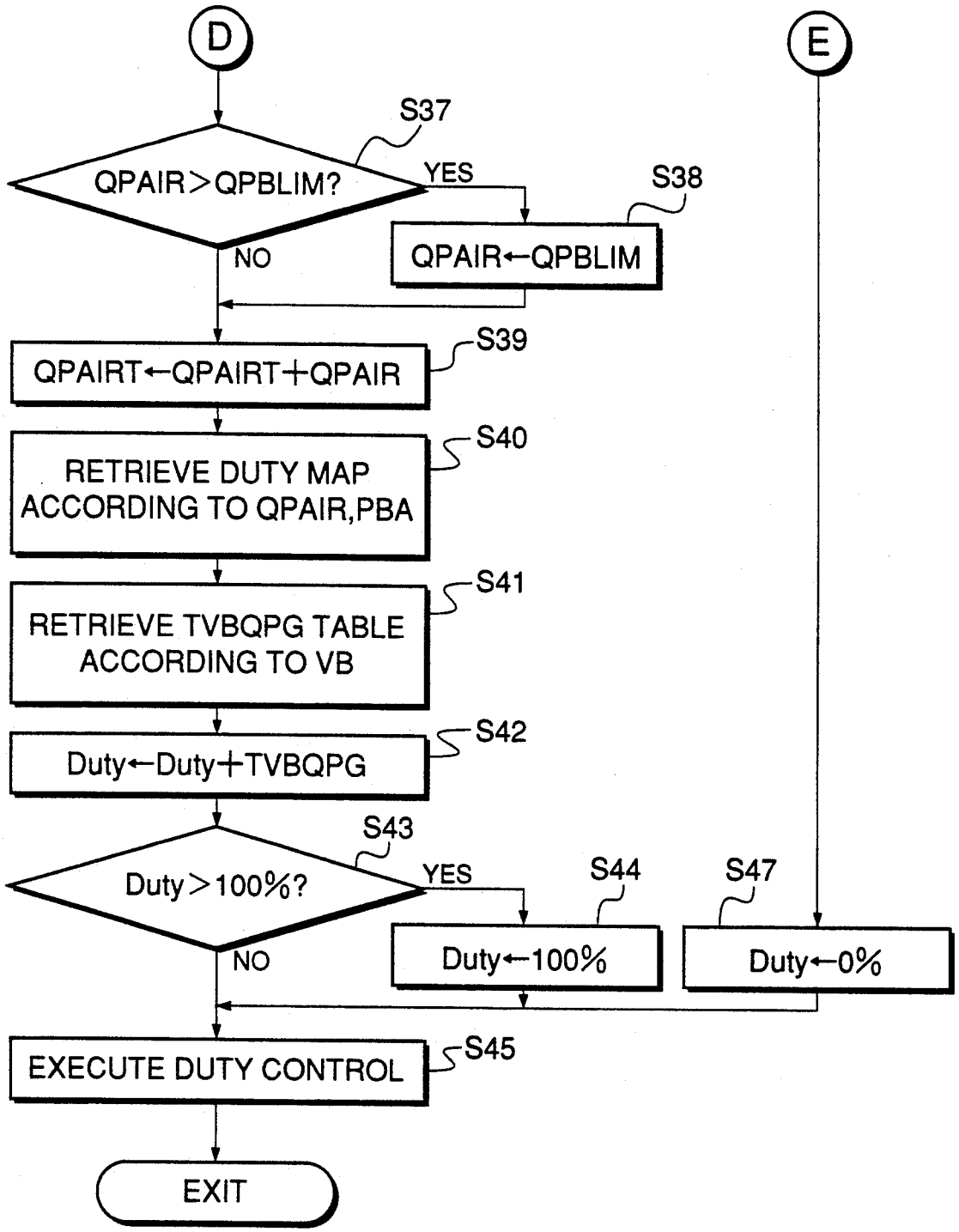
FIG. 7 is a flowchart of the rest of the program of FIG. 6.

FIG. 6 and FIG. 7 show a program for carrying out the duty control of the duty control valve 18.

First, at a step S31, it is determined whether or not the engine 1 is in the starting mode. If the answer to this question is negative (NO), i.e. if the engine is in a basic operating mode, the program proceeds to a step S32, where it is determined whether or not the flag FPRGACT, which is set in the flow rate control of evaporative fuel purged shown in FIG. 3 and FIG. 4, is equal to 1, i.e. whether or not the duty control of the duty control valve 18 should be carried out. If the answer to this question is affirmative (YES), the evaporative fuel is purged, and then at the following step S33, a flow rate-reducing coefficient KPAP, which is applied immediately after the start of purging evaporative fuel, is calculated. The flow rate-reducing coefficient KPAP is calculated according to a subroutine described hereinafter with reference to FIG. 11.

The flow rate control of evaporative fuel purged by means of the duty control valve 18 depends on the amount of intake air. However, when the cumulative volume of purged evaporative fuel is small immediately after the start of purging, it is necessary to restrict the flow rate of evaporative fuel purged since the evaporative fuel still contains a high concentration of hydrocarbons HC at such a small cumulative volume, as shown in FIG. 5. Therefore, in the present embodiment, the flow rate-reducing coefficient KPAP is used to decrease the flow rate of evaporative fuel purged. This obviates the adverse influence of hydrocarbons HC upon the exhaust emission characteristics, even if the hydrocarbons HC are contained in a high concentration in the evaporative fuel supplied from the canister 30 immediately after the start of purging during traveling of the vehicle.

Then, at a step S34, a desired flow rate QPOBJ of evaporative fuel purged is calculated by the use of the following equation (2):

$$QPOBJ=(Toutn/ME)\times KPOBJ \quad (2)$$

where Toutn is equal to a value obtained by excluding a portion corresponding to the air-fuel ratio correction coefficient KO2 and a portion corresponding to a battery voltage-dependent correction from the fuel injection period Tout of the fuel injection valve 6 calculated by the use of the equation (1), and ME the engine rotational speed, and hence Toutn/ME corresponds to an amount of intake air. KPOBJ represents a predetermined coefficient.

At a step S35, the desired flow rate QPOBJ of evaporative fuel purged calculated at the step S34 is applied to the following equation (3) to thereby multiply same by the flow rate-reducing coefficient KPAP calculated at the step S33, to determine a present value QPAIR of the flow rate of evaporative fuel to be purged:

$$QPAIR=QPOBJ\times KPAP \quad (3)$$

Figures 8, 9:
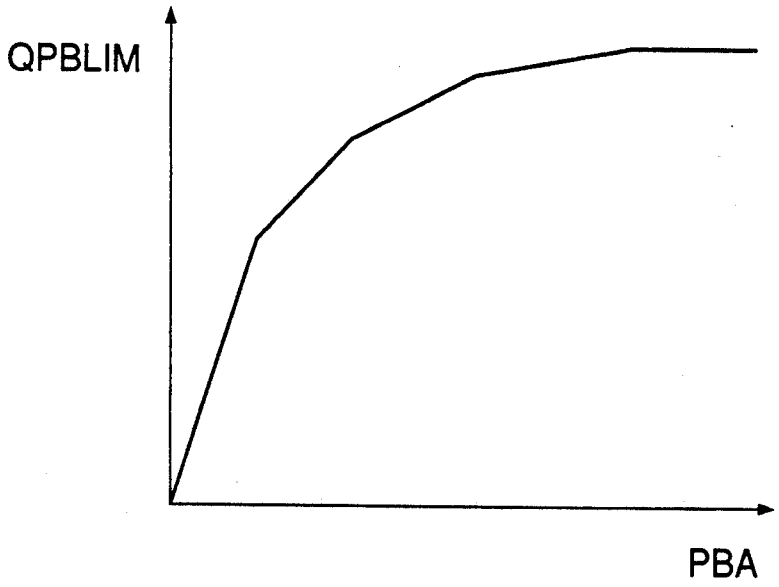
FIG. 8 shows a QPBLIM table in which values of the maximum flow rate QPBLIM of evaporative fuel purged are provided correspondingly to values of intake pipe absolute pressure PBA.
FIG. 9 shows a duty ratio map in which values of the duty ratio of the duty control valve are provided correspondingly to values of a present value QPAIR of the flow rate of evaporative fuel purged and the intake pipe absolute pressure PBA.

At the following step S36, the maximum allowable flow rate QPBLIM corresponding to the intake pipe absolute pressure PBA is retrieved by a QPBLIM table shown in FIG. 8, and then at a step S37, limit checking is carried out by comparing the present value QPAIR of the flow rate of evaporative fuel to be purged with the maximum allowable flow rate QPBLIM as a limit value. More specifically, it is determined whether or not the present value QPAIR is larger than the maximum allowable flow rate QPBLIM. If the answer to this question is affirmative (YES), i.e. if QPAIR > QPBLIM, the present value QPAIR is set to the maximum allowable value QPBLIM at a step S38, and then the program proceeds to a step S39, whereas if the answer is negative (NO), i.e. if QPAIR ≦ QPBLIM, it is judged that the flow rate of evaporative fuel to be purged does not reach the limit value, and hence the program jumps to the step S39.

At the step S39, the immediately preceding value QPAIRT of evaporative fuel purged and the present value QPAIR are added up to obtain a new cumulative flow rate QPAIRT (which is used as the immediately preceding value in the next loop). Then, the program proceeds to a step S40, where a duty ratio of the duty control valve 18 is read from a duty ratio map shown in FIG. 9 according to the present value QPAIR of the flow rate of evaporative fuel purged and the intake pipe absolute pressure PBA. In this connection, the reason why the duty ratio is dependent on the intake pipe absolute pressure PBA is that the evaporative fuel is drawn into the intake pipe by the intake pipe absolute pressure PBA, and hence even at the same amount of intake air, the amount of evaporative fuel purged varies with the intake pipe absolute pressure PBA.

Figure 10:
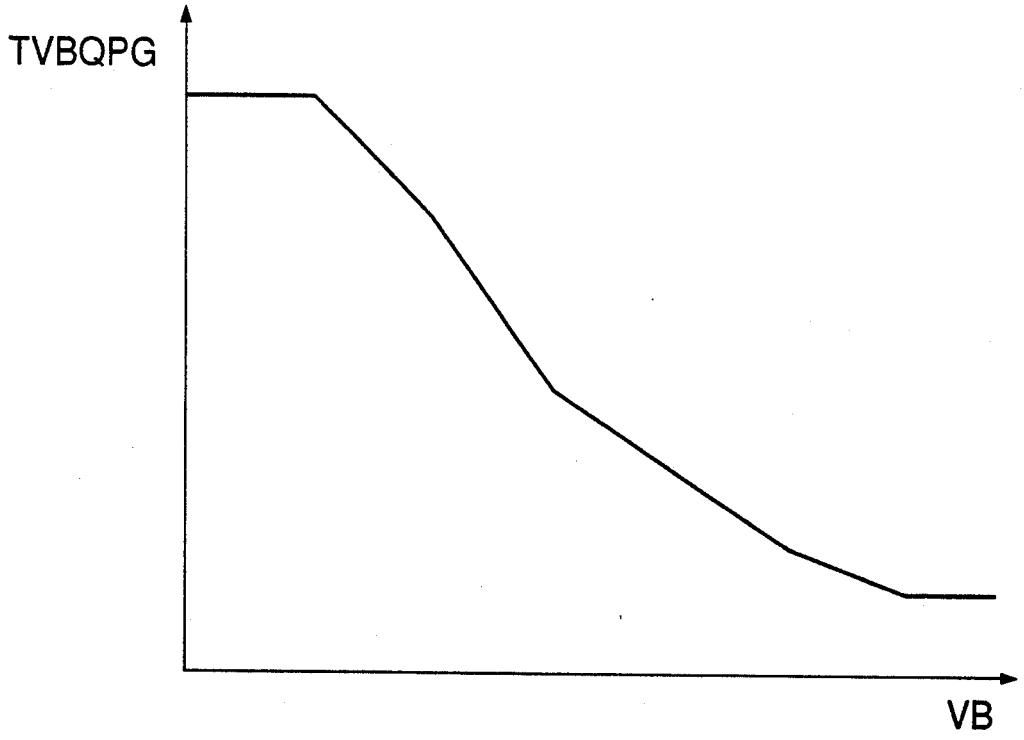
FIG. 10 shows a TVBQPG table in which values of a battery voltage-dependent correction value TVBQPG are provided correspondingly to values of a battery voltage VB.

At the following step S41, a TVBQPG table shown in FIG. 10 is retrieved to determine a battery voltage-dependent correction value TVBQPG according to the battery voltage VB. This takes into consideration the fact that the operative state of the duty control valve 18 depends on the battery voltage VB. Then, at a step S42, the voltage-dependent correction value TVBQPG determined at the step S41 is added to the duty ratio determined at the step S40 to determine a final present value of the duty ratio of the duty control valve 18. Then, at a step S43, it is determined whether or not the final present value of the duty ratio is larger than 100%. If the answer to this question is affirmative (YES), the duty ratio is corrected to 100% at a step S44, and then the program proceeds to a step S45, whereas if the answer is negative (NO), the program jumps over to the step S45, where the duty ratio is applied to duty ratio control of the duty ratio control valve 18.

Further, if the answer to the question of the step S31 is affirmative (YES), i.e. if the engine is in the starting mode, the cumulative flow rate QPAIRT is initialized to "0" at a step S46 in FIG. 6, and then the duty ratio is set to 0% at a step S47 in FIG. 7, followed by applying the duty ratio to control of the duty ratio control valve 18 at the step S45.

Figure 11:
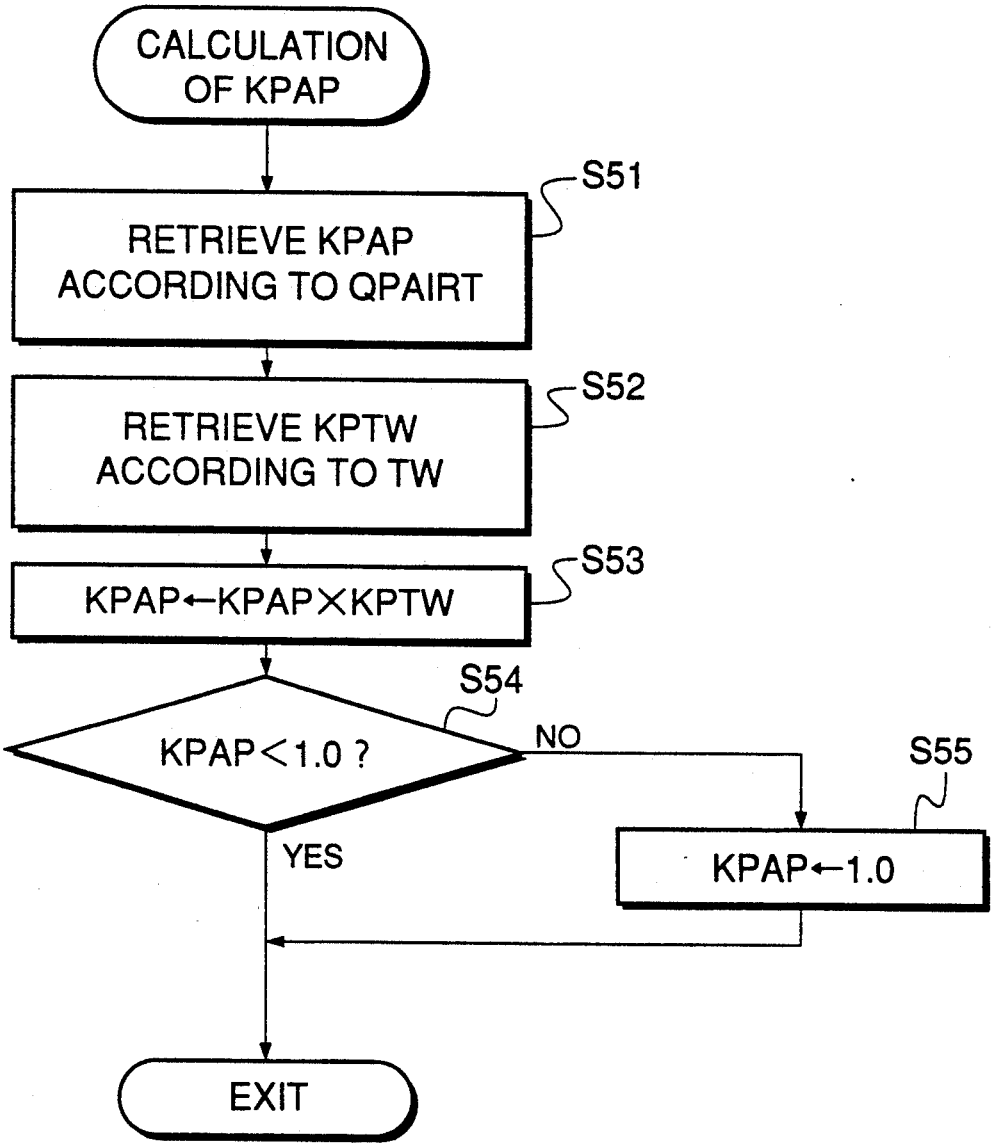
FIG. 11 is a flowchart of a program for calculating an flow rate-reducing coefficient KPAP.

FIG. 11 shows a subroutine for calculating the flow rate-reducing coefficient KPAP at the step S33 in FIG. 6.

Figure 12:
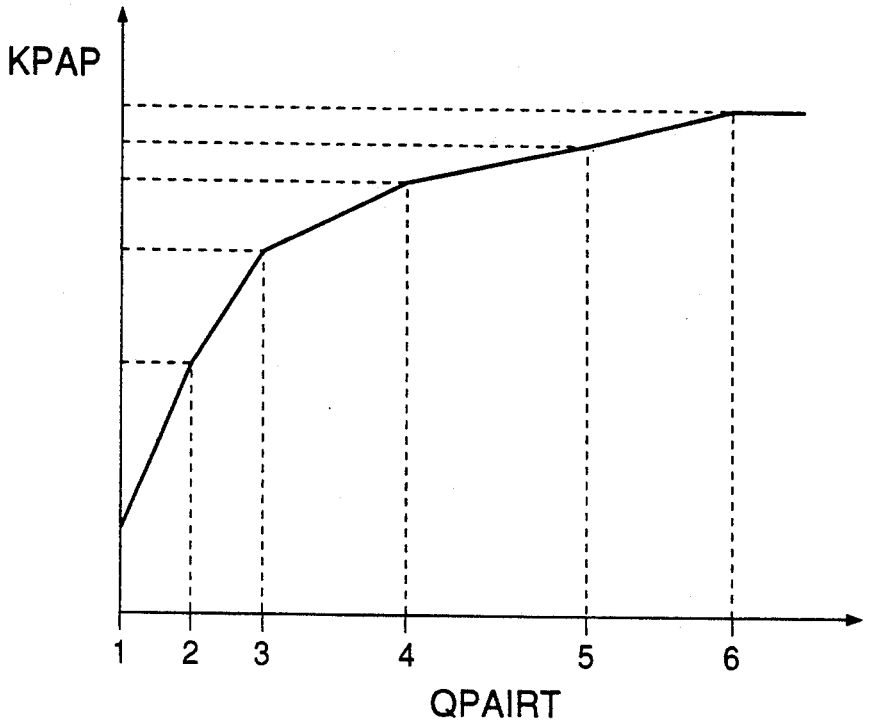
FIG. 12 shows a KPAP table in which values of the flow rate-reducing coefficient KPAP are provided correspondingly to values of the accumulated volume of evaporative fuel purged.

At a step S51, a KPAP table shown in FIG. 12 is retrieved to determine a value of the flow rate-reducing coefficient KPAP according to the cumulative flow rate QPAIRT. The flow rate-reducing coefficient KPAP always assumes a value smaller than "1.0", and increases with an increase in the cumulative flow rate QPAIRT, as shown in FIG. 12. In this connection, values of the flow rate-reducing coefficient may be set according to the number of TDC signal pulses generated after the start of the engine or a count value of a counter for measuring a time period elapsed after the start of the engine, instead of the cumulative flow rate QPAIRT.

Figure 13:
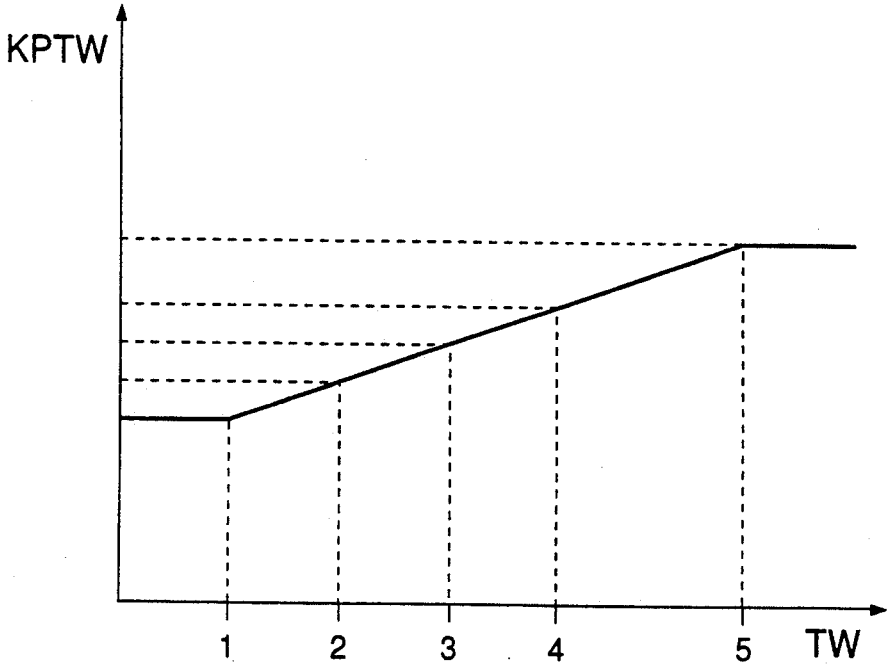
FIG. 13 shows a KPTW table in which values of a coolant temperature-dependent correction coefficient KPTW are provided correspondingly to values of a coolant temperature TW.

Further, at the following step S52, a KPTW table shown in FIG. 13 is retrieved to determine a coolant temperature-dependent correction coefficient KPTW according to the coolant temperature TW. The coolant temperature-dependent correction coefficient KPTW is provided for purging evaporative fuel at a restricted flow rate when the engine temperature is low, since at a low temperature of the engine, a three-way catalyst, not shown, for purifying exhaust gases is not fully activated so that purged evaporative fuel containing a high concentration of hydrocarbons HC can adversely affect the exhaust emission characteristics. Therefore, the KPTW table of FIG. 13 is set such that the lower the coolant temperature TW, the smaller the correction coefficient KPTW.

Then, at a step S53, the flow rate-reducing coefficient KPAP determined at the step S51 is multiplied by the coolant temperature-dependent correction coefficient KPTW determined at the step S52 to obtain a final present value of the flow rate-reducing coefficient KPAP. Then, at a step S54, it is determined whether or not the flow rate-reducing coefficient KPAP is smaller than "1.0". If the answer to this question is affirmative (YES), the subroutine is terminated, whereas if the answer is negative (NO), the flow rate-reducing coefficient KPAP is set to "1.0", followed by terminating the subroutine.

What is claimed is:

1. In an evaporative emission control system for an internal combustion engine having a fuel tank, an intake passage, and a throttle valve arranged in said intake passage, said evaporative emission control system including a charcoal canister for adsorbing evaporative fuel generated from said fuel tank, a communication passage communicating between said charcoal canister and a portion of said intake passage downstream of said throttle valve, and a first control valve arranged in said communication passage for controlling supply of said evaporative fuel at a flow rate dependent on an operating parameter of said engine, the improvement comprising:

a bypass passage bypassing said first control valve and having a maximum flow rate smaller than the maximum flow rate of said first control valve;

a second control valve arranged in said bypass passage for controlling opening and closing of said bypass passage; and control means for closing said first control valve and at the same time opening said second control valve, when said engine is in a warming up state.

2. An evaporative emission control system according to claim 1, including:

temperature detecting means for detecting a temperature of said engine;

wherein said warming up state of said engine is that said temperature of said engine detected by said temperature detecting means is below a first predetermined value.

3. An evaporative emission control system according to claim 2, wherein said control means closes said first control valve and said second control valve to stop supply of said evaporative fuel to said engine, when said temperature of said engine is below a second predetermined value lower than said first predetermined value.

4. An evaporative emission control system according to claim 2, wherein said control means closes said first control valve and said second control valve to stop supply of said evaporative fuel to said engine, when said engine is idling and at the same time said temperature of said engine is below said first predetermined value.

5. In an evaporative emission control system for an internal combustion engine having a fuel tank, an intake passage, and a throttle valve arranged in said intake passage, said evaporative emission control system including a charcoal canister for adsorbing evaporative fuel generated from said fuel tank, a communication passage communicating between said charcoal canister and a portion of said intake passage down-stream of said throttle valve, and a first control valve arranged in said communication passage for controlling supply of said evaporative fuel at a flow rate dependent on an operating parameter of said engine, the improvement comprising:

a bypass passage bypassing said first control valve and having a maximum flow rate smaller than the maximum flow rate of said first control valve;

a second control valve arranged in said bypass passage for controlling opening and closing of said bypass passage; and control means for closing said first control valve and at the same time opening said second control valve, over a predetermined time period after said engine starts.

6. In an evaporative emission control system for an internal combustion engine having a fuel tank, an intake passage, and a throttle valve arranged in said intake passage, said evaporative emission control system including a charcoal canister for adsorbing evaporative fuel generated from said fuel tank, a communication passage communicating between said charcoal canister and a portion of said intake passage down-stream of said throttle valve, and a first control valve arranged in said communication passage for controlling supply of said evaporative fuel at a flow rate dependent on an operating parameter of said engine, the improvement comprising:

a bypass passage bypassing said first control valve and having a maximum flow rate smaller than the maximum flow rate of said first control valve;

a second control valve arranged in said bypass passage for controlling opening and closing of said bypass passage; and control means for closing said first control valve and at the same time opening said second control valve, when said engine is idling.

7. An evaporative emission control system according to claim 6, wherein said control means inhibits supply of said evaporative fuel to said engine during idling when said engine has not been warmed up.

* * * * *